US010427923B2

(12) United States Patent
Gimenez Vergara

(10) Patent No.: US 10,427,923 B2
(45) Date of Patent: Oct. 1, 2019

(54) CENTRAL ROTATING COLUMN WITH HORIZONTAL HYDRAULICALLY DRIVEN MOVEMENT ARRANGED IN A DUMP BODY AND WATER TRUCK BODY EXCHANGE SYSTEM HAVING TWO ADJACENT WORKING AREAS, COMPRISING AN INTERNAL HYDRAULIC TANK AND WITH AN INTERNAL VERTICAL TRAVELING SUPPORT ATTACHED TO AN ARM

(71) Applicant: Patricio Francisco Gimenez Vergara, Antofagasta (CL)

(72) Inventor: Patricio Francisco Gimenez Vergara, Antofagasta (CL)

( * ) Notice: Subject to any disclaimer, the term of this patent is extended or adjusted under 35 U.S.C. 154(b) by 150 days.

(21) Appl. No.: 15/314,855

(22) PCT Filed: May 28, 2015

(86) PCT No.: PCT/CL2015/000035
§ 371 (c)(1),
(2) Date: Nov. 29, 2016

(87) PCT Pub. No.: WO2015/184560
PCT Pub. Date: Dec. 10, 2015

(65) Prior Publication Data

US 2017/0137267 A1 May 18, 2017

(30) Foreign Application Priority Data

May 30, 2014 (CL) ..... 1442-2014

(51) Int. Cl.
*B66F 3/24* (2006.01)
*B66F 3/46* (2006.01)
(Continued)

(52) U.S. Cl.
CPC ..... *B66F 3/46* (2013.01); *B66F 3/24* (2013.01); *B66F 3/30* (2013.01); *B66F 7/20* (2013.01); *B66F 7/28* (2013.01); *B66F 1/02* (2013.01)

(58) Field of Classification Search
CPC ..... B66F 3/46; B66F 3/24; B66F 3/30; B66F 7/28; B66F 1/02
(Continued)

(56) References Cited

U.S. PATENT DOCUMENTS 4,328,951 A 5/1982 Laupper
6,634,461 B1 * 10/2003 Baker ..... B66F 3/46 187/210
(Continued)

FOREIGN PATENT DOCUMENTS

CL 20130000239 6/2013
CN 2302920 Y * 1/1999
(Continued)

OTHER PUBLICATIONS

Foreign Translation (Year: 1999).*
International Search Report and Written Opinion from PCT/CL2015/0000035 dated Sep. 4, 2015.

*Primary Examiner* — Monica S Carter
*Assistant Examiner* — Abbie E Quann
(74) *Attorney, Agent, or Firm* — DLA Piper LLP (US)

(57) ABSTRACT

A central column allowing a 360° rotation on its central axis comprises mechanical safety locks and load sensors for safe operation in vertical and horizontal movements. The central rotating column may be part of a mounting and dismounting system for mining truck dump bodies and water truck bodies, providing two adjacent working areas. The lifting system for dump bodies of mining trucks and bodies of water trucks comprises a vertically adjustable mechanical lock; a spring-actuated automatic lock horizontally holding
(Continued)

the column in position; an automatic rotation lock preventing the column from rotating while in operation; a toothed crown and pinion assembly integrated to the rotating base and allowing a 360° movement, and a load sensor preventing the horizontal movement of the column under load.

12 Claims, 6 Drawing Sheets

(51) Int. Cl.

| | |
|---|---|
| ***B66F 3/30*** | (2006.01) |
| ***B66F 7/20*** | (2006.01) |
| ***B66F 7/28*** | (2006.01) |
| *B66F 1/02* | (2006.01) |

(58) Field of Classification Search
USPC .... 254/89 R, 93 R, 2 B, 93 L, 134; 700/213; 269/58, 17
See application file for complete search history.

(56) References Cited

U.S. PATENT DOCUMENTS

| | | | | |
|---|---|---|---|---|
| 8,313,086 | B2 * | 11/2012 | Gray | B66F 3/24 254/134 |
| 2012/0048656 | A1 * | 3/2012 | West | G01R 31/2887 187/250 |
| 2012/0211709 | A1 * | 8/2012 | Givens | B25J 9/1065 254/93 R |
| 2014/0201963 | A1 | 7/2014 | Zamorano Jones et al. | |
| 2014/0224147 | A1 * | 8/2014 | Scomparin | B66B 9/003 104/107 |
| 2015/0251883 | A1 * | 9/2015 | Miranda | B66F 7/22 254/3 C |

FOREIGN PATENT DOCUMENTS

| | | | |
|---|---|---|---|
| CN | 2302920 Y | * | 1/1999 |
| WO | WO 2000/056638 | | 9/2000 |

* cited by examiner

CENTRAL ROTATING COLUMN WITH HORIZONTAL HYDRAULICALLY DRIVEN MOVEMENT ARRANGED IN A DUMP BODY AND WATER TRUCK BODY EXCHANGE SYSTEM HAVING TWO ADJACENT WORKING AREAS, COMPRISING AN INTERNAL HYDRAULIC TANK AND WITH AN INTERNAL VERTICAL TRAVELING SUPPORT ATTACHED TO AN ARM

CROSS REFERENCE TO RELATED APPLICATIONS

This application is a U.S. National Stage Application of International Application No. PCT/CL2015/000035 filed May 28, 2015, which claims priority from Chilean Patent Application No. 1442-2014 filed May 30, 2014. The entirety of all the above-listed applications are incorporated herein by reference.

BACKGROUNDS

At present, in mining operations in Chile and around the world, the exchange of dump bodies of mining trucks and bodies of water trucks is performed with the suspended load working method, using one or two high tonnage loading cranes, equipped with heavy lifting devices.

The state of the art shows two patent applications submitted in Chile, numbered 200302430 and 200701876, which publish a mining truck dump body lifting system comprising four adjustable columns, comprising a vertical traveling support arm; main function of the system is the mounting and dismounting of mine truck bodies; replacing the concept of suspended load and introducing the concept of supported load. In the second patent application, number 200701876, the mining truck dump body lifting system published comprises six adjustable columns. In this system, the two central columns rotate 180°, allowing the operation in two adjacent working areas.

In both systems described in these patent applications, operational risks posed by the vertical and horizontal movements of the columns were identified. Should the lifting column hydraulic cylinder fail to operate, the worker would need to access the vertical traveling support arm climbing up in a ladder up to the position of the vertical traveling support arm and then triggering a mechanical locking system with the inherent risk of dump body falling on the operator and/or the operator falling down from height; for these reasons this invention now comprises automatic mechanical safety locks in each column with the purpose of preventing the horizontal and vertical movements of the column; triggering of these locks is made from the base of each column.

Another concern on the prior art relates to the positioning and horizontal movement of the column as the systems published in patent applications numbers 200302430 and 200701876 only include hydraulic locking valves, which in case of failure, do not prevent the horizontal hydraulically-driven movement of the central rotating column under load. For this reason, this invention now comprises load sensors in each column, connected to the lifting system, for the purpose of detecting and locking any horizontal movement of columns under load, thus also preventing an operator from activating a horizontal movement with the columns under load. This sensor is located in the hydraulic lifting system and blocks the horizontal movement.

Also, the frequent use of the 180° toothed crown of the turntable in the central rotating column, results in a quick wear of turntable bearing teeth thus requiring shutting down the lifting system for servicing or repairing worn out parts.

With the purpose of providing a solution to the above mentioned concerns, the design includes a central column allowing a 360° rotation on its central axis, also comprising mechanical safety locks and load sensors for a safe operation in vertical and horizontal movements.

DESCRIPTION OF THE UTILITY MODEL

Figure 1:
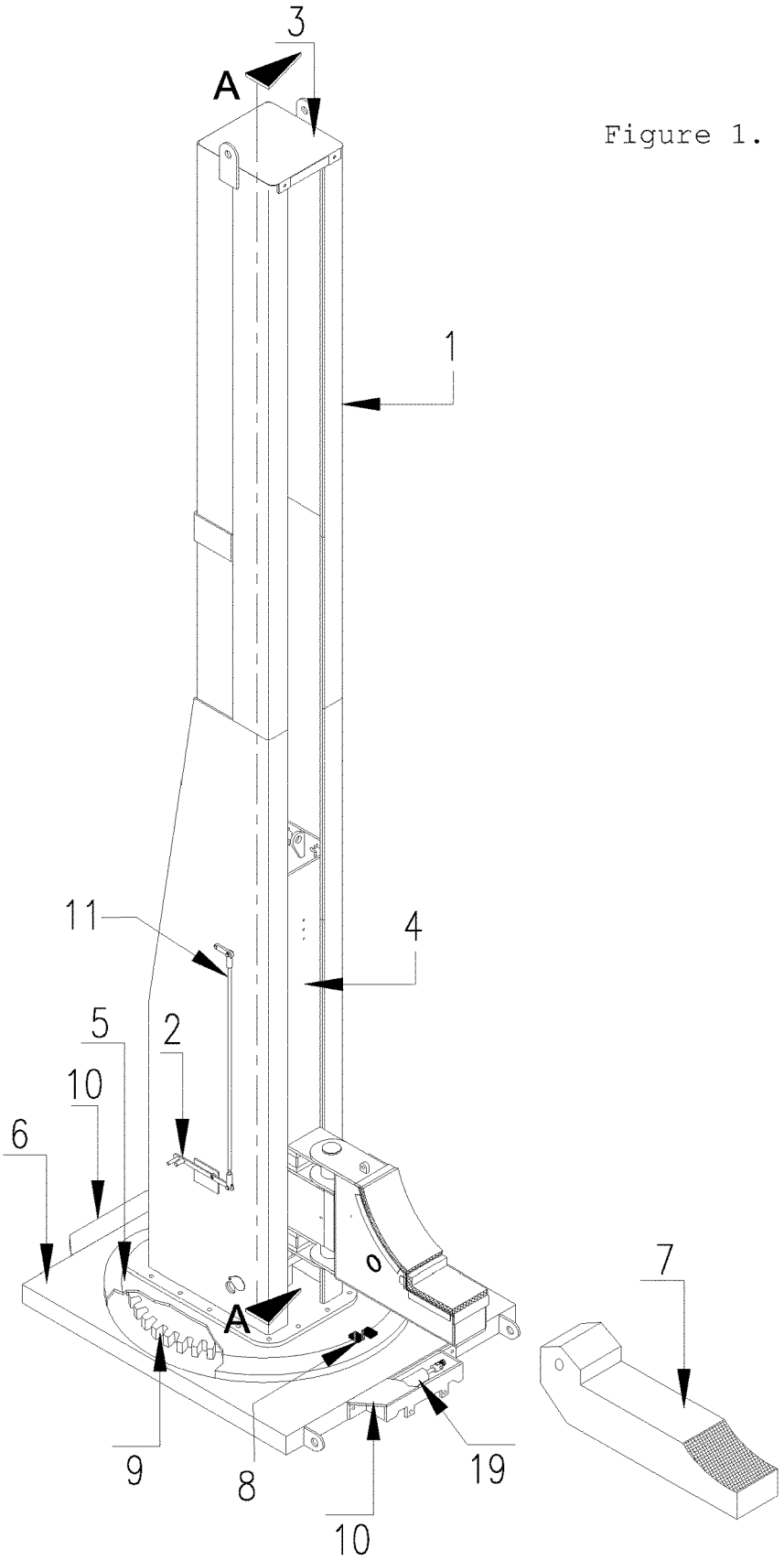
FIG. 1 is a perspective view of the central rotating column.
Figure 2:
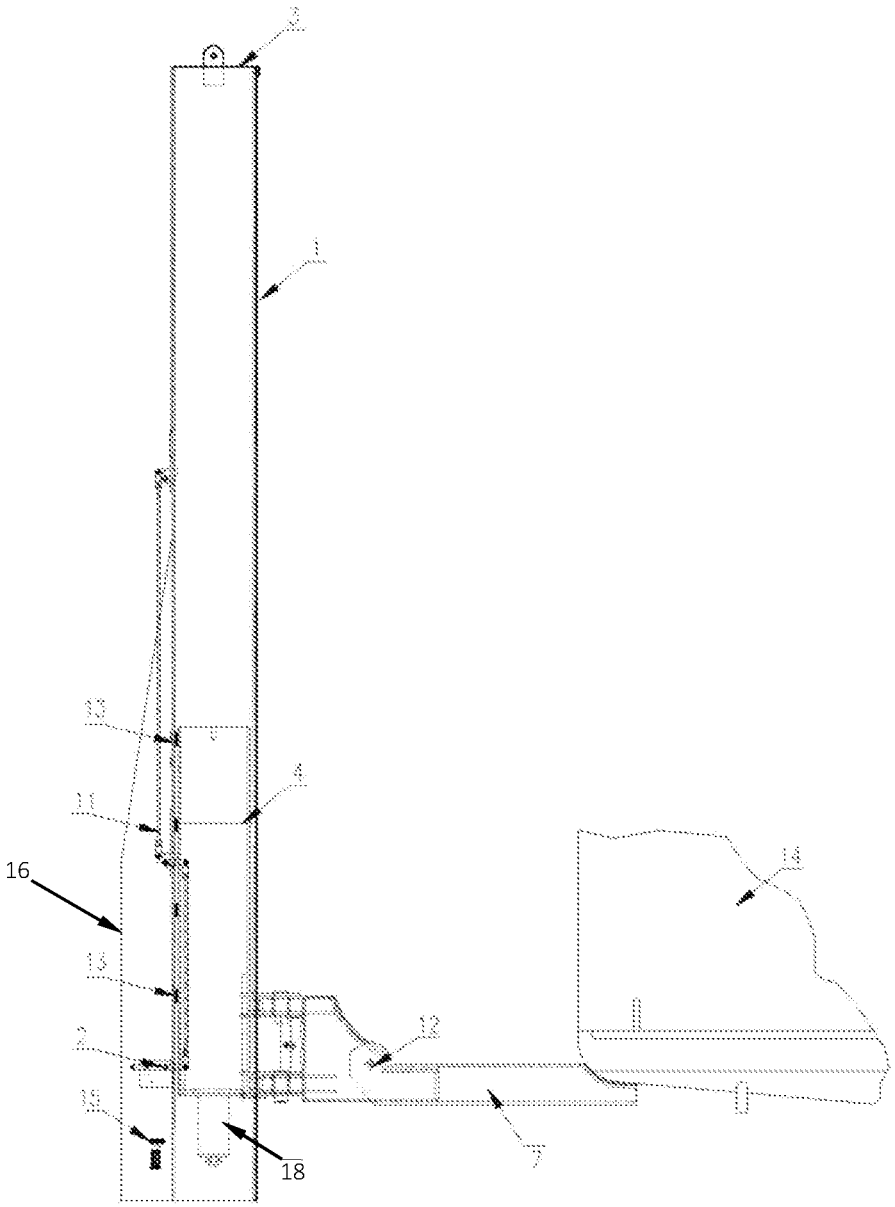
FIG. 2 is a detail of the A-A' longitudinal section of the central rotating column.
Figure 3:
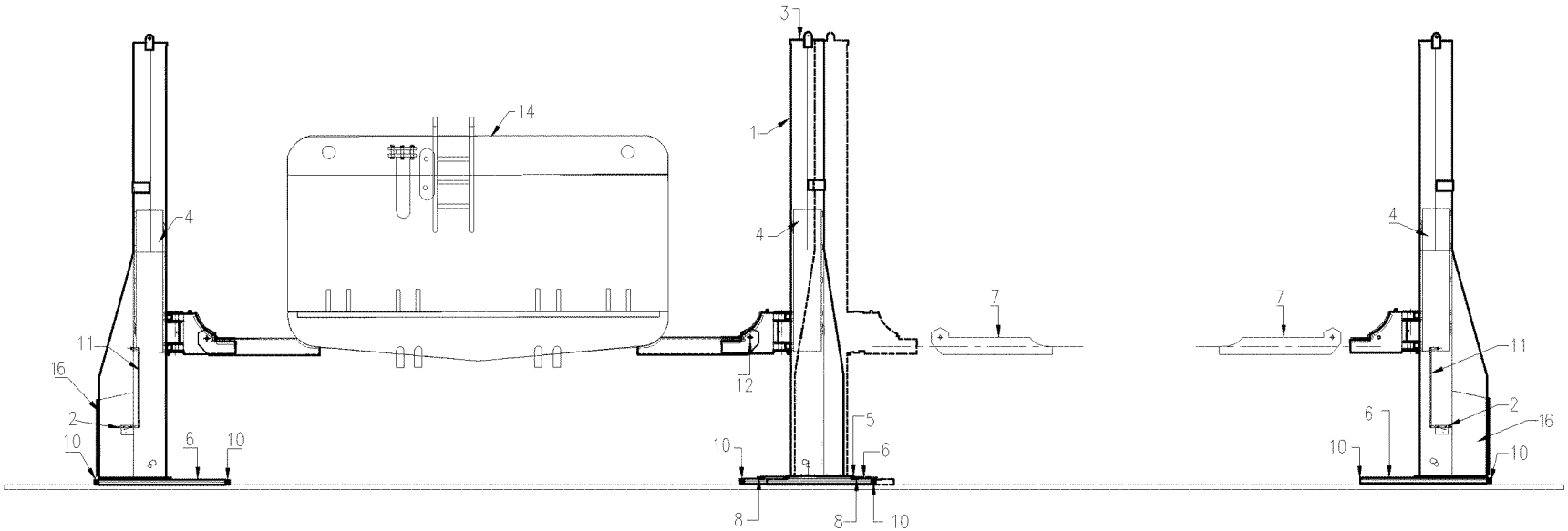
FIG. 3 is a front view of the central rotating column arranged in the dump body and water truck body exchange system with its two adjacent working positions.
Figure 4:
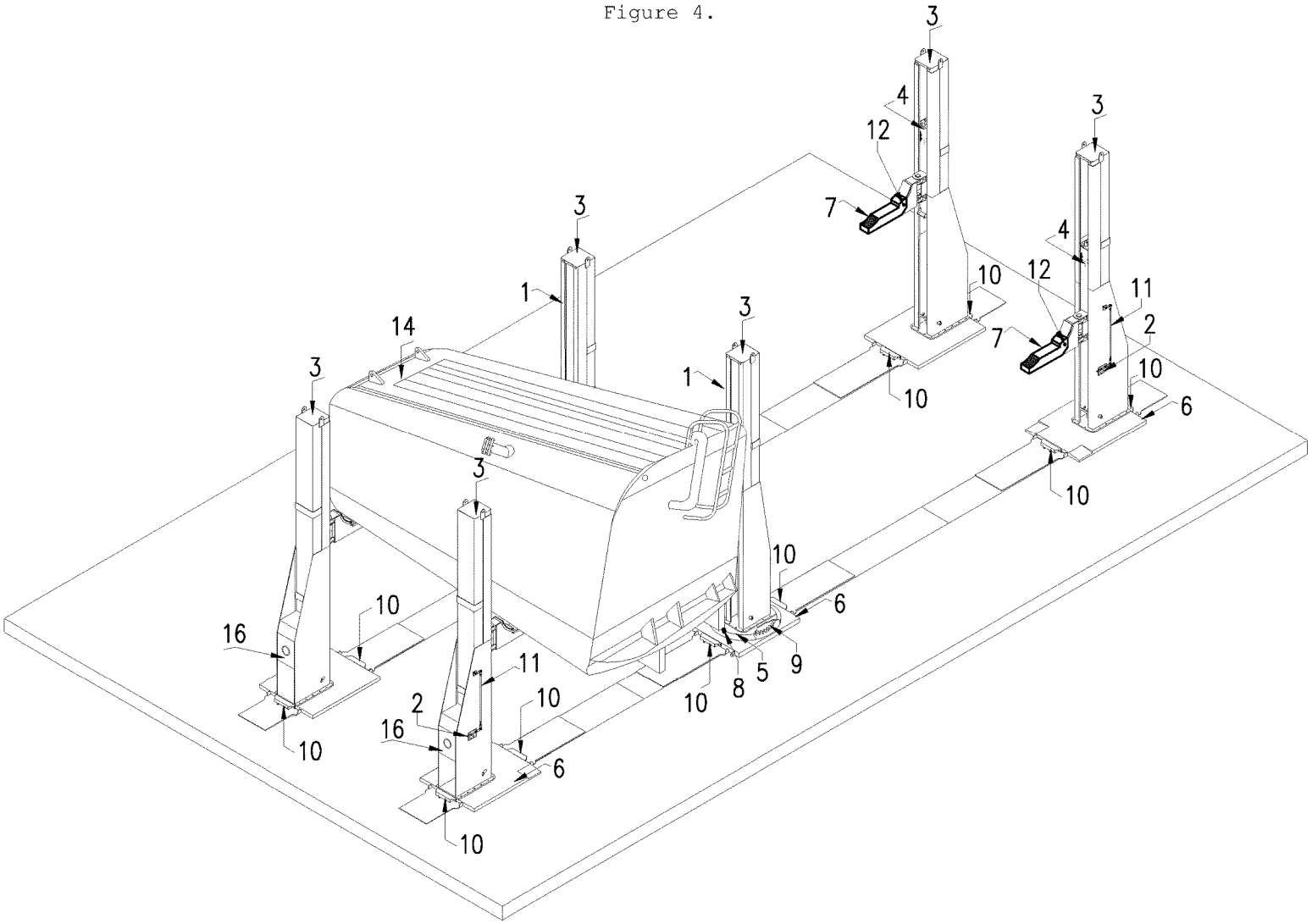
FIG. 4 is a perspective view of the central rotating column included in the dump body and water truck body exchange system.
Figure 5:
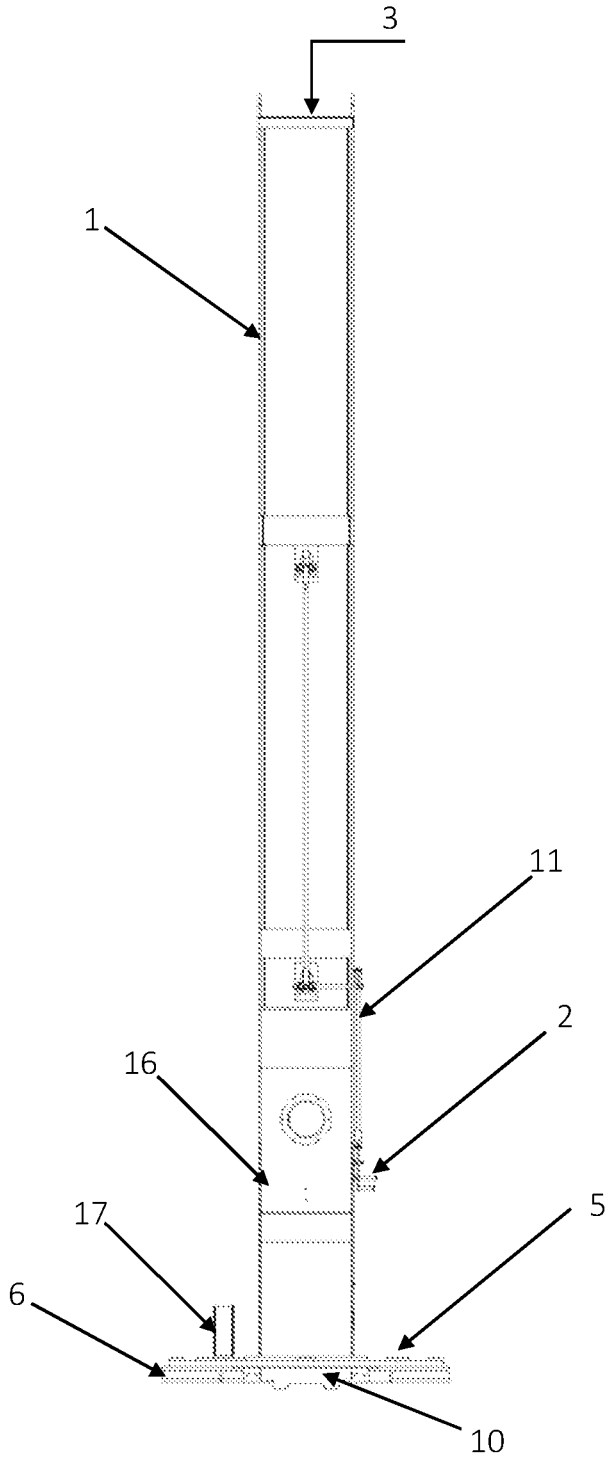
FIG. 5 is a back view of the central rotating column.
Figure 6:
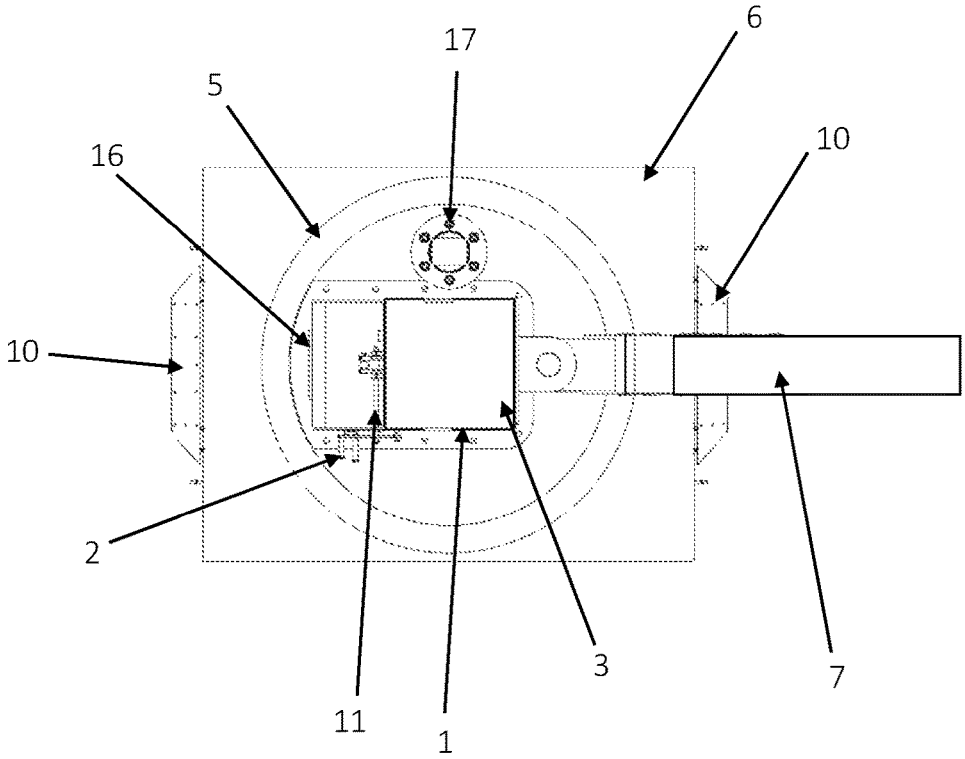
FIG. 6 is a top view of the central rotating column.

Referring to FIGS. 1-6, the proposed utility patent model is designed for the mining industry; specifically as an aid for the mounting and dismounting of mining trucks dump bodies and water truck bodies (14).

Particularly, the present invention relates to a central rotating column (1) having autonomous mobility and including operational safety accessories for its vertical and horizontal movements and a turning device for 360° rotation. This central rotating column (1) is part of a mounting and dismounting system for mining truck dump bodies (14) and water truck bodies having two adjacent working areas.

The above mentioned operational safety accessories include:

A vertical movement adjustable mechanical safety lock that prevents accidental downward movement of the vertical traveling support arm (4) actuated by means of an external locking lever (2) located in a lower area of the central rotating column (1), thus assuring a quick and safe operation for workers. This mechanical safety lock allows positioning of the vertical traveling support arm (4) at different height levels.

An automatic spring-actuated mechanical lock, driven by hydraulic cylinder (18) acting on a spring mechanism, that horizontally holds the central rotating column (1) in position blocking the horizontal hydraulically-driven movement of the central rotating column (1) in case of failure in the hydraulic pressure, and preventing the horizontal hydraulically-driven movement of the central rotating column (1).

An automatic rotation lock (8) preventing the rotation of the central rotating column (1) during lifting operations; i.e. when the central rotating column (1) is operating under the load of a dump body or water truck body (14).

A crown and pinion assembly (9) for 360° rotational movement, so arranged that the crown is mounted on the square base (6) supporting the central rotating column (1), and a motor driven pinion is mounted in the inner side of the crown, being an integral part of the rotating base (6) of the central rotating column (1).

A load sensor (15) preventing the horizontal hydraulically-driven movement of the central rotating column (1) under load, assuring that independently of the operation mode—horizontal or vertical—should an operator try to activate a movement of the central rotating column (1), the operation will be blocked guaranteeing operator's safety and a safe operation.

With the drawings as reference, the present utility model comprises a central rotating column (1) made of structural steel, featuring in its interior a hydraulic oil tank (16) supplying the central rotating column (1) internal hydraulic system. Also built in inside the central rotation column (1) there is a traveling structure which by means of a pin is assembled to a supporting arm, forming the vertical traveling support arm (4) assembly for vertical movements. The pin is a pivot type pin allowing the vertical traveling support arm (4) to turn 90° for easy access and positioning of the mining truck. The turning motion is activated and controlled by means of a remote control board.

The vertical movement of the traveling supporting arm (4) is performed by means of a hydraulic system including a hydraulic cylinder (18).

This traveling support arm (4) is vertically adjusted at the central rotating column (1) according to the shape and size of the dump body or water truck body (14). The vertical traveling support arm (4) includes an upper limit switch (3) preventing the vertical traveling support arm (4) from traveling out of the central rotation column (1), in case of operator miscalculation during lifting operations.

As a safety device for the vertical movement of the vertical traveling support arm (4) in case of failure of the hydraulic cylinder (18), the central rotating column (1) includes a vertical safety mechanical lock (11), automatically activated and adjustable in height within a defined range of height levels (13). The quick activation of the vertical safety mechanical lock (11) is achieved by means of an external lever (2) located in a lower area of the central rotating column (1); the vertical safety mechanical lock is unlocked to allow adjustment in height of the vertical traveling support arm (4) and to perform the exchange of dump bodies and water tank bodies (14).

On this vertical traveling support arm (4) a structural steel accessory (7) is mounted for the purpose of enlarging the sized of the supporting surface, forming a longer arm. The design of this structural steel accessory (7) allows working and handling any kind of water truck bodies (14) existing in a market. The structural steel accessory (7) assembly, disassembly and haulage to a storage area is made by means of a separate lifter, as an operator may require. The assembly of the structural steel accessory (7) is performed lowering the vertical traveling supporting arm (4) down the central rotating column (1) to a height lower than the separate lifter carrying the structural steel accessory (7), so that the structural steel accessory (7) be placed on the vertical traveling support arm (4) and automatically mounted when raising the vertical traveling support arm (4) up along the central rotating column (1) by means of the hydraulic cylinder (18) of a central rotating column (1). The structural steel accessory (7) is fastened to the vertical traveling support arm (4) in its position at the central rotating column (1) by means of a pin (12).

The horizontal movement of the central rotating column (1) is designed to adjust to the different widths of the dump bodies and water truck bodies (14) supported; adjustment is made by means of hydraulic cylinders manually operated from the base (6) of the central rotating column (1); that is to say the central rotating column (1) travels horizontally independent from the other columns included in this dump body and water truck body (14) exchange system. For the purpose of adjusting the horizontal position of the central rotating column (1) as required by an operator, the base (6) of the central rotating column (1) features a mechanical spring-actuated automatic safety lock (10). In case of hydraulic pressure failure, this safety lock prevents the horizontal hydraulically-driven movement of the central rotating column (1). Manual operation switch is located in the base (6) of the central rotating column (1), thus avoiding miscalculations, as an operator must be right beside the central rotating column (1) to activate the central rotating column (1) movement, resulting in a safer operation.

The central rotating column (1) rotates on a vertical axis driven by the rotational movement of the turntable (5) which comprises a crown and pinion assembly (9) mounted on the square base (6). The crown is mounted on the square base (6) and the pinion rotates, driven by a hydraulic motor (17), as a single assembly with the central rotating column (1).

The crown and pinion assembly (9) is toothed all around 360° in order to enable rotation of the central rotating column [1) in both directions, allowing the skid-arm (4) to access both adjacent working areas. The 360° toothed crown and pinion assembly (9) results in longer life and extended maintenance periods.

So as to avoid accidental turn of the central rotating column (1) an automatic rotation lock (8) has been installed, preventing the central rotating column (1) rotation during lifting operations.

The invention claimed is:

1. A central rotating column made of structural steel, having a horizontal hydraulically-driven movement, arranged in a dump body and water truck body exchange system, able to access two adjacent working areas, and featuring a hydraulic oil tank in an interior of said central rotating column; the central rotating column includes a vertical traveling support arm vertically traveling by means of a hydraulic cylinder, also including a 90° swing movement; the central rotating column rotates on a vertical axis mounted on a 180° rotating turntable, the turntable includes a hydraulic motor driven crown and pinion assembly being an integral part of the base of the central rotating column comprising: an adjustable vertical safety mechanical lock activated by an external locking lever preventing accidental downward travel of the vertical traveling support arm; a mechanical spring-actuated automatic safety lock adjusting the horizontal hydraulically-driven movement of the central rotating column; an automatic rotation lock preventing the central rotating column from rotating during lifting operations; the hydraulic motor driven crown and pinion assembly allowing 360° rotation of the central rotating column; a structural steel accessory attached to the vertical traveling support arm to enable operation with water tank bodies; and a load sensor preventing the horizontal hydraulically-driven movement of the central rotating column under load.

2. The central rotating column made of structural steel, having the horizontal hydraulically-driven movement, as recited in claim 1, wherein the central rotating column includes an upper limit switch limiting the vertical travel of the vertical traveling support arm and preventing the vertical traveling support arm from traveling out of the central rotation column during said lifting operations.

3. The central rotating column made of structural steel, having the horizontal hydraulically-driven movement, as recited in claim 1, wherein the external locking lever of the vertical safety mechanical lock is arranged in a lower area of the central rotating column.

4. The central rotating column made of structural steel, having the horizontal hydraulically-driven movement, as recited in claim 1, wherein the vertical traveling support arm is positioned at different height levels by the external locking lever of the vertical safety mechanical lock.

5. The central rotating column made of structural steel, having the horizontal hydraulically-driven movement, as recited in claim 1, wherein the structural steel accessory is designed to allow manipulation of water truck bodies; the structural steel accessory is assembled, disassembled and hauled to a storage area by means of a separate lifter, as an operator may require.

6. The central rotating column made of structural steel, having the horizontal hydraulically-driven movement, as recited in claim 1, wherein assembly of the structural steel accessory on the vertical traveling support arm of the central rotating column is performed by vertically moving the vertical traveling support arm down to a height lower than a position of the structural steel accessory, and, with the aid of a separate lifter, the structural steel is advanced on the vertical traveling support arm, and automatically assembled upon being mounted on the vertical traveling support arm of the central rotating column.

7. The central rotating column made of structural steel, having the horizontal hydraulically-driven movement, as recited in claim 1, wherein the structural steel accessory is locked in position to the vertical traveling support arm by a pin.

8. The central rotating column made of structural steel, having the horizontal hydraulically-driven movement, as recited in claim 1, wherein the mechanical spring-actuated automatic safety lock is arranged in the base of the central rotating column.

9. The central rotating column made of structural steel, having the horizontal hydraulically-driven movement, as recited in claim 1, wherein the mechanical spring-actuated automatic safety lock blocks the horizontal hydraulically-driven movement of the central rotating column in case of lack of hydraulic pressure in the hydraulic cylinder.

10. The central rotating column made of structural steel, having the horizontal hydraulically-driven movement, as recited in claim 1, wherein the automatic rotation lock is located in the hydraulic motor crown and pinion assembly on the base of the central rotating column.

11. The central rotating column made of structural steel, having the horizontal hydraulically-driven movement, as recited in claim 1, wherein the automatic rotation lock prevents accidental rotation of the central rotating column in case of lack of hydraulic pressure in a hydraulic motor.

12. The central rotating column made of structural steel, having the horizontal hydraulically-driven movement, as recited in claim 1, wherein the load sensor prevents the horizontal hydraulically-driven movement of the central rotating column when the vertical traveling support arm is under load in case of hydraulic pressure in the hydraulic cylinder of the central rotating column.

* * * * *